US005448843A

United States Patent [19]

Schwartz

[11] Patent Number: 5,448,843

[45] Date of Patent: Sep. 12, 1995

[54] LOW POWER DRAIN ILLUMINATED SIGN

[75] Inventor: Steven Schwartz, Slaterville, N.Y.

[73] Assignee: Spectralight Signs and Lighting, Inc., Ithaca, N.Y.

[21] Appl. No.: 135,252

[22] Filed: Oct. 12, 1993

[51] Int. Cl.[6] ..... G09F 13/04

[52] U.S. Cl. ..... 40/570; 40/550; 40/581; 362/347; 362/812

[58] Field of Search ..... 40/452, 550, 551, 570, 40/581; 362/235, 347, 812

[56] References Cited

U.S. PATENT DOCUMENTS

| | | | |
|---|---|---|---|
| 796,475 | 8/1905 | Turner . | |
| 4,028,828 | 6/1977 | Chao et al. . | |
| 4,259,800 | 4/1981 | Schoenfeld . | |
| 4,967,317 | 10/1990 | Plumly . | |
| 5,186,537 | 2/1993 | Katoh et al. | 362/347 |

FOREIGN PATENT DOCUMENTS

| | | | |
|---|---|---|---|
| 463345 | 2/1914 | France | 40/570 |
| 210954 | 9/1960 | Germany | 362/235 |

*Primary Examiner*—Brian K. Green
*Attorney, Agent, or Firm*—Bernard, Brown & Michaels

[57] ABSTRACT

An illuminated sign apparatus comprised of a reflector with dedicated cavities which are formed by having the perimeter walls of each cavity conform precisely to each individual area of the sign desiring illumination, typically alphabetic characters and the background area they create. The bottom walls of these cavities will project towards the viewers eye parabolically. The midpoint of the cavity, when viewed in cross section, is to be slightly less in height than that of the cavity-defining perimeter walls. The perimeter walls have point source lights such as light emitting diodes (LEDs) distributed along their surface. These cavities may be filled in with transparent substance, fully encapsulating the LEDs thereby eliminating any reflective air space and facilitating light diffusion. The light sources may be provided with circuitry allowing unique powering to each of the individual cavities, resulting in the possibility of a variety of different display effects.

14 Claims, 2 Drawing Sheets

LOW POWER DRAIN ILLUMINATED SIGN

FIELD OF THE INVENTION

The invention pertains to the field of illuminated signs. More particularly, the invention pertains to signs, particularly "EXIT" signs, which are illuminated by a plurality of near-point-source low drain lights such as Light Emitting Diodes (LEDs), in which the sign presents a uniformly illuminated appearance.

BACKGROUND OF THE INVENTION

Every state in America has regulations concerning the installation of "EXIT" signs in public buildings. In large part, these regulations are the result of work done by the "Committee On Safety To Life" of the National Fire Protection Association (NFPA), which was first appointed in 1913. For the first few years of its existence, the Committee devoted its attention to a study of notable fires involving loss of life, and to analyzing the causes of that loss of life. This work led to the preparation of standards for the construction of stairways, fire escapes, and, over the years, to the suggested embodiment of the exit signs themselves.

Signs designed for alerting the public to safe exit from a building in case of emergency can range from a simple flat, non-illuminated plastic decal to the elaborate lighted designs generally seen in larger buildings. In such applications, the law requires an illuminated sign with a battery back-up system to guard against failure in the event of a power outage. Where there are a large number of such signs, power usage becomes a real concern.

The first powered EXIT signs utilized incandescent or florescent bulbs for their illumination source. These signs were simple and straightforward in their design, comprising single or dual incandescent or fluorescent white light bulbs in a box, with one side an opaque panel with the word "EXIT" cut out. A colored plastic sheet was placed between the light source and this panel. The colored plastic sheet served the dual purpose of giving color to the light output and affording a degree of diffusion to the light in an attempt to avoid hot spots in the signs appearance.

This attempt at even illumination is a stated objective of the NFPA code, paragraph 5-10.3.4. This section of the code states that "Every sign required by 5-10.1.4 shall provide evenly illuminated letters having a minimum luminance of 0.06 footlamberts."

Another common approach was to paint the word "EXIT" in one color on a contrasting translucent panel, placed in front of a light source. Local codes may specify certain colors, but by convention, the letters are usually red on a green background. As the entire light source transmission is directed to the face of the sign, it is accepted that this creates a more noticeable display. It is also understood that with the display being in two contrasting colors, greater recognizability, particularly in smoky conditions, is realized.

In a changing and competitive manufacturing economy, there are always new market forces which become the causative factors guiding the design of consumer products. In the case of EXIT, and indeed any electric sign, the cost of powering these appliances has become the prime concern governing their design and marketability. Towards this end, the Light Emitting Diode (LED) exit sign has come into use. These LED signs improve upon the operation of their predecessors.

Bulb burnout is essentially eliminated. The light output of LEDs is high, while their power consumption is low, and their low voltage requirement is well suited to battery backup systems. However, there is one aspect to the LED sign which results in a drawback to their usage as a light source for signs of any type, particularly exit signs.

A principal object of this invention is to provide an LED sign which gives the display appearance of the higher power consumption but greater visibility incandescent or florescent signs.

Prior art LED signs utilize many lights (hundreds, in some applications), pointing outwards toward the viewer. Since LEDs are nearly point light sources, like small spot lights, their output being in the shape of a forwardly projecting cone, the appearance of such signs is that of many small dots (which I term "pointillist"). This quality makes it difficult for LED signs to conform to section 5-10.3.4 of the NFPA code described above, when used within their usual design constraints. The "evenly illuminated letters" of this section refers to the type of illumination which was attained in the past when one or several incandescent or florescent light sources were placed in a box with cut out or translucent panels as described above.

In view of the significant advantages realized by the use of LEDs, the NFPA has been allowing their use even though they give a "pointillist" nature to a sign's appearance, and forfeit having the entire face of the sign illuminated by two contrasting colors. The LED signs of the prior art utilize a variety of approaches to come as close as possible to attaining the appearance called for by the NFPA code which, while not stipulating any actual design methods, lead very strongly towards a back lit type of sign using a single or dual light source.

A further object of the invention is to utilize the LEDs in a manner whereby their "pointillist" output will be diffused to give the impression of even illumination of letters.

To approximate, as closely as possible, the appearance of these incandescent signs, manufactures of LED signs have taken two approaches. One is to have the front panel of the sign made of an opaque material, paint it with the desired word and have the center line of each stroke of each letter drilled with holes to accept LEDs penetrating this panel. These signs, because they add no diffusion to the generated light, tend to use LEDs which are themselves diffused to aid in affording as wide a viewing angle as possible. Others place focused LEDs behind a cut-out panel as in the conventional back lit signs previously described, but include another panel of a highly light diffusing material. This second approach actually represents the same approach as in the incandescent signs. There are also signs which place diffused LEDs behind clear panels.

These signs' major drawbacks are that they incorporate significant amounts of light loss due to the fact that they are illuminating the entire interior of the sign's housing. In addition, they are passing the light through multiple layers of materials, incorporating a reflective air space between each. This represents a light loss for each layer due to this reflectance. There are also losses involved due to mismatching between the wavelength of the generated light and the color temperature of the layered materials involved.

Another object of the invention is to provide an LED illuminated sign while minimizing reflective or absorptive losses of the generated light.

The approaches of incorporating LEDs to exit signs described above fall short of fulfilling the NFPA code completely and precisely. They are only capable of illuminating the letter stroke in an insufficient manner, and are incapable of giving illumination in a contrasting color to the area of the sign's face which is not letter stroke (termed the "background").

A further object of the invention is to provide a sign which is capable of illuminating the letter stroke and background area of the sign face separately in two or more contrasting colors.

A number of illuminated signs have been patented. The following examples are considered relevant to the invention.

Turner, U.S. Pat. No. 796,475, represents the most obvious method of illuminating a sign, similar to the large signs commonly seen in amusement parks or advertising signs. Individual lamps are mounted in a reflective channel given the shape of the desired letter. The lamps are incandescent, each having their own socket and wired together in parallel. The resultant appearance of letters constructed in this manner would be for them to have a pointillist quality. In other words, the hot spot of each light bulb would be very evident. FIG. 3 shows that there is some kind of transparent cover over the reflective channel, presumably to either give color to the emitted light, for protection or both. There are a number of disadvantages to this arrangement: Heat will build up, causing a shortened lamp or other component life; When light passes through even an apparently clear substance, there is a light loss of four percent or greater due to reflectance and absorption; and Turner's sign is constructed without the benefit of printed circuit board methods of manufacture, which automate much of the required assembly.

Chao, U.S. Pat. No. 4,028,828, teaches individual letters insertable into a powered track. The letters utilize light bulbs placed in direct line with the viewer's eye, creating hot spots. In this design there is also the condition, even more pronounced than in the above invention, of complete enclosure of the light bulbs, creating heat build up. In claim one of Chaos' invention, it states in line thirteen that the described characters must be hollow, which again creates the condition of the loss of illumination efficiency through reflectance and absorption. While this invention does utilize the advantage of printed circuit board fabrication, the PCB is a separate entity to the housing which comprises the reflector, or the portion of the embodiment which gives shape to the light being emitted.

Schoenfeld, U.S. Pat. No. 4,259,800, approaches the direction in which my invention leans. The characters to be illuminated are given asymmetrically shaped reflective chambers. These chambers are given a basic shape conforming to the major dimensions of height and width of the given character. The condition of the light passing through space and hitting a reflective surface is still evident, creating the transmittance loss mentioned previously. It is also apparent that the bulbs are positioned in a central location, creating hot spots, or more accurately, in this case, dull spots due to the fact that the outer regions of each character are positioned at maximum distances from the bulbs. In the detailed description, column three, third paragraph, Schoenfeld teaches that the lenses should be cast out of a single material with the face of the monolithic structure, and covered with a paint or some other translucent substance. This creates a condition wherein there is a limited amount of bright light being transmitted through this face, giving the brightest illumination to the lenses. The bulbs are in a central location only, creating a different cross section of the reflector at any location within a given cell. There is a sequencing of the characters illuminated. There is mention given to there being the ability of the different lenses changing color, but still the background of each lens will be of the same color, only of a different degree of brilliance.

Plumly, U.S. Pat. No. 4,967,317, shows a sign utilizing incandescent bulbs imbedded in a layer of plastic which diffuses and conducts the light to minimize the pointillist aspect of the bulbs. A face plate has an opaque layer which is cut out to form the letters. Largely, it falls into the same trap of losses due to the reasons mentioned above with the Schoenfeld sign.

SUMMARY OF THE INVENTION

The invention is an LED-illuminated sign, especially applicable to exit signs, which optionally permits separate contrasting illumination of letters and background. Each letter and, optionally, background area, comprises a shaped cavity, illuminated indirectly by a plurality of near-point sources such as light-emitting diodes arranged around the periphery of the cavity, with the light emitted by the sources pointed inwards. The center of each cavity is formed of an opaque substance, formed into a convex shape or "hump" midway between the light sources around the edges of the area. The "hump" is slightly lower than the edges of the cavity, and the areas between the "hump" and the edges are approximately in the form of parabolas. The sources illuminate the "hump", and the light is evenly reflected upward toward the viewer, giving the illusion of a solid letter or background. The cavities may be filled with a transparent substance.

DESCRIPTION OF THE PREFERRED EMBODIMENT

Figure 1:
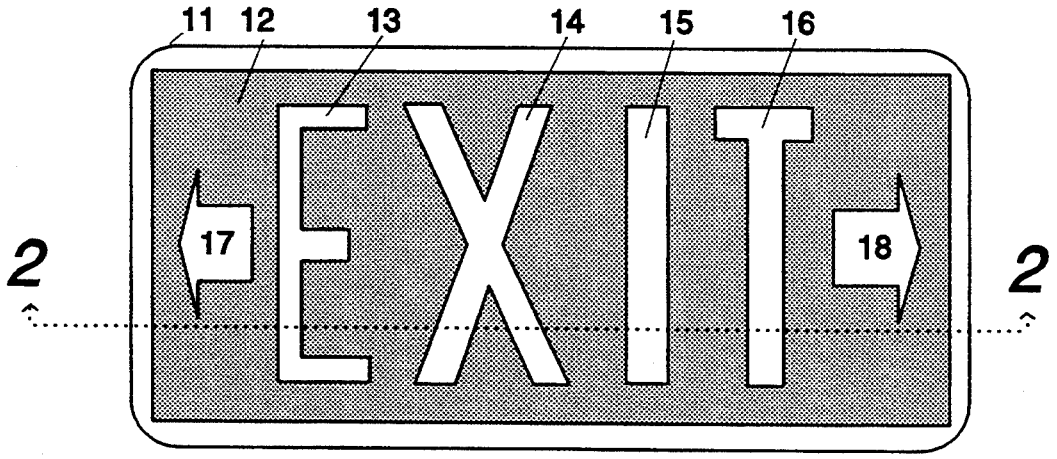
FIG. 1 shows a front view of the sign of the invention.

FIG. 1 shows the sign of the invention.

The design of the preferred embodiment lends itself to easy mounting, as will be seen. The sign itself is thin, and the electronics required to drive the sign light sources may be either mounted on the rear of the sign, or may be on a separate circuit board. In either case, relatively little space is needed for drivers, and the only additional space requirement on a mounting would be for a power supply and/or battery, if such are needed. The sign may be mounted on a box for mounting on a wall, or be mounted under a box for ceiling mounting, within the teachings of the invention. The details of the mounting are conventional, and form no part of the invention.

The sign is formed of a background area (12) (i.e. the area outside of letter strokes) and a plurality of letters (13) to (16), in this case forming the word "EXIT". In the EXIT sign application, it may be desired to include a pair of arrows (17) and (18), as will be seen below. Although the description of the preferred embodiment will hereafter be in terms of the "EXIT" sign application, it will be understood that the invention is not limited to these letters, only.

The sign will preferably be surrounded by a frame or mounting flange (11), and may have a cover of glass or plastic for protection (not shown).

Figure 2:
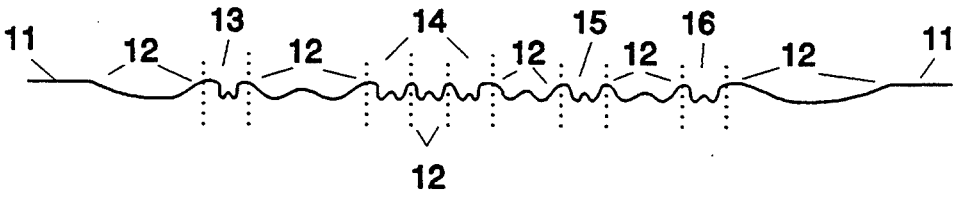
FIG. 2 shows a cut-away side view of the invention, along line 2—2 of FIG. 1.

The sign backing is illustrated in FIG. 2, which is a cross section through the sign along the line 2—2 in FIG. 1. This backing is molded into a specific shape, which make the objects of the invention possible.

The areas of the sign which form the mounting flange (11), background areas (12), and the letters "E" (13), "X" (14), "I" (15), and "T" (16) are marked on FIG. 2. The part of the sign which makes up one stroke of a letter is detailed in FIG. 3.

Figure 3:
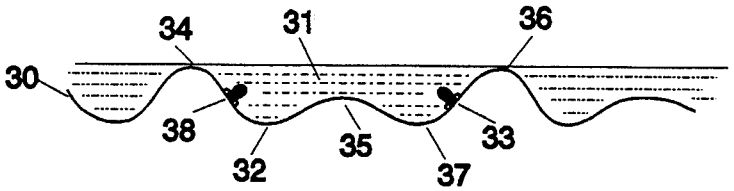
FIG. 3 shows a detail of a single section of a letter of the sign of the invention.

As can be seen in the detailed FIG. 3, each area (background, letter stroke, arrow) is formed by a trough molded into the backing, bordered by a relatively high projection—sections (34) and (36) forming the left and right boundaries of the letter stroke illustrated. Halfway between the higher edge projections the backing again bulges outward into a central projection (35), approximately half the height of the edges. The trough between the edge and central projections (32) and (37) is approximately parabolic in shape.

A plurality of miniature low drain point light sources (33) and (38), such as LEDs, are mounted in the inward-facing slopes of the edge projections (34) and (36) along all of the edges of the letter strokes. The light sources shine inwards toward the central projection (35), rather than outwards toward the viewer as in the prior art. The light from the light source (33) mounted in one edge projection (36) illuminates the slope of the central projection (35) facing the light source, and the facing slope of the opposite edge projection (34). Similarly, the other slopes are illuminated by the facing light source (38).

The light sources could be surface-mount LEDs as is preferred and shown in the drawing, or could be conventional LEDs protruding through the backing. Alternatively, the LED's could be vacuum deposited directly on the surface of the backing along with the circuitry during the manufacture of the sign, a relatively new technique which has been used in a number of other applications such as some toys and calculators or the like. It will be understood by one skilled in the art that, while "LEDs" are the preferred light sources today, that other equivalent low drain point-source devices may be available or developed in the future and used within the teachings of the invention.

The slopes reflect the light from the sources evenly forward toward the viewer, so that the viewer sees only the indirect illumination from the lighted troughs and not the direct pointillist light from the point light sources. This gives the even illumination required by the NFPA standard.

Because of the large reflecting area, the number of light sources needed to fill in the letter strokes evenly is far less than that required in prior art signs where the lights themselves are used to fill in the strokes. With the number of lights required being drastically reduced, the current drain of the sign is correspondingly reduced.

The light from the sources may be additionally diffused, and the light sources protected, by filling the troughs will a transparent substance (31), preferably a plastic resin chosen from the many available to the art. The resin is preferably colored the same as the LEDs, to aid in the diffusion and provide color when the lights are off. The resin in the letter stroke area and in the background area are preferably tinted in contrasting colors.

Figure 4:
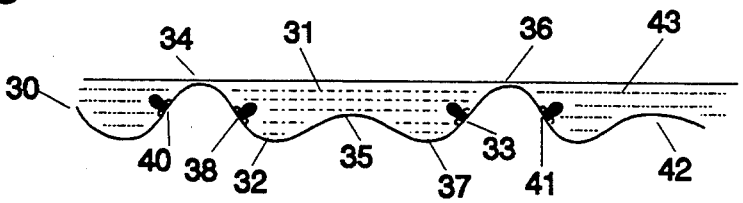
FIG. 4 shows a variation on the sign of FIG. 3, in which the letter and background are separately illuminated.

FIG. 4 shows the same detail as FIG. 3, in the preferred embodiment having the background areas (12) illuminated in a contrasting color to the letter strokes. This can be easily accomplished by adding additional light sources (40) and (41) in the outward-facing slopes of the edge projections (34) and (36). The background illumination LEDs illuminate the central projections of the background areas (30),(42), in the same manner as described above for the letter strokes.

According to the code, the letter strokes and background areas should be illuminated in contrasting colors. This is easily accomplished by using commonly available red and green LEDs for the stroke and background illumination, respectively. In such a case, the troughs of the letter strokes will be filled with red-tinted resin, and the background areas filled with green-tinted resin.

Another possibility for color assignment is opened up if commonly available bi-color LEDs are used for the sources. These LEDs light in red if powered in one polarity, green in the opposite polarity, and yellow if fed with AC. This would allow the sign to be flashed in alternating red-and-green colors in case of an emergency. In the alternative, two strings of single-color LEDs could be provided in contrasting colors in each area, and alternately powered to change the color.

All of the LEDs can be connected together, or preferably, the LEDs for the letters, background and arrows will be separately powerable.

In the preferred embodiment of the invention, the conductors for the LEDs, which are connected in parallel, are formed onto the front of the sign molding, connected to one another by surface deposition of copper traces such as have been in use in PCB technology for many years now. In conventional PCB fabrication, copper is etched away to form the desired conductive paths, this being done on a flat surface, which is then drilled and loaded with components. There is a process in use today which fosters the creation of PCBs which have a contoured, ridged shape. Generally, this process is employed to make possible the elimination of the PCB as a separate entity in a products design. Surface mounted components can be distributed about the inside surface of the housing, making the housing itself also the PCB. Once the housing is made, the trace pattern of the circuit is designed in such a way that it conforms to the housings contour. This pattern is then optically projected onto this surface with the intent of creating a mask which will only allow the deposition of copper to be in the desired areas to form the conductive areas of the circuit. Copper is then vaporized and induced in a manner similar to electroforming to deposit in the desired locations.

Figure 5:
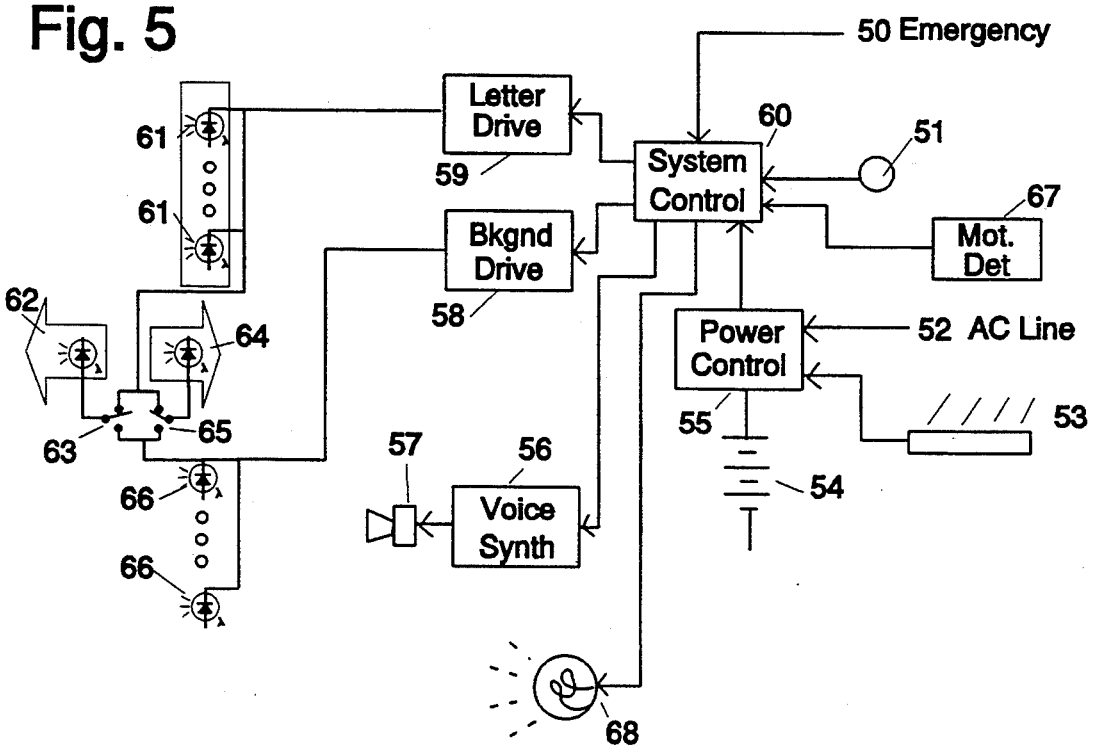
FIG. 5 shows a block diagram of the control circuitry of the invention.

FIG. 5 shows a block diagram of a system for powering the preferred embodiment of the invention. In its simplest state, there need only be a power source (55)

and appropriate drive circuitry (59) for the LEDs (61) illuminating the letter strokes.

The LEDs illuminating the left (62) and right (64) arrows will preferably have individual switches (63) and (65), allowing the installer to power the appropriate arrow(s) for wherever the sign is mounted. In the case of a one-color sign, the switches need only be single-pole single-throw (SPST), to turn the appropriate arrow on or off. In the preferred two-color embodiment shown, the switches switch the arrows from foreground color to background color. The single-pole double throw (SPDT) switch arrangement shown would be appropriate when bi-color LEDs are used, simply switching the LEDs from the foreground to the background drive polarity. When the LEDs are switched to foreground color (i.e. red), the arrow stands out from the contrasting background. When switched to the background color (i.e. green), the arrow blends into the background and becomes invisible. It will be recognized by one skilled in the art that the same effect can be achieved with single-color LEDs by putting two sets of LEDs in each arrow, one for each color, and using double-pole single-throw (DPST) switches at (63) and (65) to enable or disable each color LED array.

The power source (55) could work from a power input (52) of 120 VAC ("line voltage"), or 10–20 VAC low voltage power which could use simpler wiring, or even a DC voltage from a central battery backup source, depending on the building application. The power source will then regulate the higher supply voltage down to the 1.5–3 VDC required by the LEDs. Other point light sources may require other voltages, which the ordinary person skilled in the art could derive from the supply voltage using any of the many power supply circuits commercially available or known to the art.

Preferably, if there is no battery backup supply available from the building, a backup battery (54) will be included in the sign, charged by the power source (55) from the line (52).

In addition to the energy savings realized due to maximizing the use of the generated light, the present invention may optionally be capable of utilizing the available light which is essentially always present in the areas of an exit sign installation. A significant power savings can be realized by incorporating a system whereby a photovoltaic panel (53) is placed in the top of the closest lighting fixture or the most suitable spot given the specific location of each individual sign. The purpose of this panel would be to charge the battery (54). This battery, charged essentially at no cost, and separate from the power back-up battery, would be available to run the sign without line power whenever it had reached a fully charged condition. This system of photovoltaic charging of a battery meant only for this power saving feature would significantly reduce power consumption by having the sign's electrical power requirements satisfied independent of the building power source for a portion of its operation.

In the preferred embodiment having contrasting illumination of the background areas, the LEDs in the background (66) will preferably be powered by their own driver circuits (58), allowing independent control of the letters and background areas. The letter drive (59) and background drive (58) circuits may be as simple as voltage regulators, or may include polarity switching capability for use with bi-color LEDs, or means for switching between two color strings, if it is desired to flash alternate colors in an emergency.

The system control circuit (60) will be needed for more complicated embodiments of the invention. It may have an input from the building emergency alarm system (51), which could be a simple contact closure, or a voltage derived from the alarm horns or bells from the system. This would be used to trigger either simple flashing of the exit sign lights, or the color reversals discussed above.

Yet another object of the invention is to further minimize power consumption by having the display be on only during times of area occupancy, this being accomplished by combining timing in the system control (60) and possibly by including an input for motion detection circuitry (67). The motion detector could be any one of the many known to the art, from active sonar systems or IR detectors, to entirely passive piezoelectric sensors such as those manufactured by Pennwalt Manufacturing Company.

A voice synthesizer (56), providing an audible voice from a speaker (57) mounted on or near the sign, can provide additional warning as needed. A strobe light (68) can also be provided as an option.

The system control (60) will preferably incorporate an emergency specific, multiple stage, highly recognizable and attention getting operation to the signs functionality as responses to emergency conditions. This will be accomplished by incorporating the following emergency mode responses:

STAGE 1: Normal operation, which will be characterized by having the display be on in one or two colors.

STAGE 2: Power outage operation, which will be characterized by having the display, if two color, switch letter stroke color and background color alternately at a rate of a color switch every one or two seconds. If display is one color, display will blink at the same rate. If sign is voice equipped, appropriate message will be repeated, such as "Building is experiencing a power outage".

STAGE 3: Fire operation, being characterized by rapid blinking of the sign, or, if available, by rapid color reversals. A flashing strobe light, either in an arrow shape indicating the exit direction or in the middle region of the sign, can add to the effect, perhaps accompanied by appropriate voice message, such as "exit in direction of flashing arrow".

Accordingly, it is to be understood that the embodiments of the invention herein described are merely illustrative of the application of the principles of the invention. Reference herein to details of the illustrated embodiments are not intended to limit the scope of the claims, which themselves recite those features regarded as essential to the invention.

I claim:

1. An illuminated sign comprising:

a sign body comprising a plurality of illuminated letters each having a characteristic shape, and a background area surrounding the letters, each letter comprising a trough formed in the shape of the letter, the trough comprising:

two edge projections having a length forming the shape of the letter, and having a height, an inward-facing slope and outward-facing sides facing into the background area, and a central projection located between the edge projections having a height which is approximately half the height of the edge projections, and outward facing sloped sides, each of the outward facing sloped sides of the central projection smoothly meeting the inward facing slope of an edge projection, forming two concave troughs between the central projection and the edge projections, a plurality of point light sources attached to the inward-facing slopes of the edge projections of the letters, spaced along the edge projections, and facing inward to illuminate the sloped side of the central projection facing the light sources and the inward-facing slope of the other edge projection.

2. The illuminated sign of claim 1 in which the point light sources are light emitting diodes.

3. The illuminated sign of claim 1 in which the background area is also illuminated.

4. The illuminated sign of claim 3 in which the background area is in a contrasting color to the letters.

5. The illuminated sign of claim 3 in which the sign body further comprises a margin having an inward facing edge bounding the background area, and the background area comprises:

a plurality of background border areas formed by the outward-facing sides of the edge projections forming the plurality of letters of the sign and the inward facing edge of the margin, and a central projection located between the background border areas having sloping sides and a height which is approximately half the height of the edge projections of the letters, each of the sloping sides of the central projection of the background area smoothly meeting the background border areas, forming two concave troughs between the central projection of the background area and the background border areas, a plurality of point light sources attached to the outward-facing sides of the edge projections of the letters, spaced along the edge projections of the letters, and facing outward to illuminate the sloped side of the central projection of the background area facing the light sources and the opposing background border area.

6. The illuminated sign of claim 5 in which the point light sources are light emitting diodes.

7. The illuminated sign of claim 5 in which the background area around the letters is filled with a transparent substance.

8. The illuminated sign of claim 7 in which the transparent substance is plastic resin.

9. The illuminated sign of claim 7 in which the transparent substance is tinted in the same color as the point light sources.

10. The illuminated sign of claim 1 in which the point light sources are bicolor light emitting diodes, such that the color of illumination may be chosen by varying the power supply to the diodes.

11. The illuminated sign of claim 1 in which there are two separate groups of point light sources in contrasting colors, such that the color of the illumination may be chosen by illuminating either group of point light sources.

12. The illuminated sign of claim 1 in which the troughs forming the letters are filled with a transparent substance.

13. The illuminated sign of claim 12 in which the transparent substance is plastic resin.

14. The illuminated sign of claim 12 in which the transparent substance is tinted in the same color as the point light sources.

* * * * *